US005961437A

United States Patent [19]

Smith et al.

[11] Patent Number: 5,961,437

[45] Date of Patent: Oct. 5, 1999

[54] MULTI-LAYER WASTE CONTAINMENT BARRIER

[75] Inventors: Ann Marie Smith, Pocatello; Bradley M. Gardner; David F. Nickelson, both of Idaho Falls, all of Id.

[73] Assignee: Lockheed Martin Idaho Technologies Company, Idaho Falls, Id.

[21] Appl. No.: 08/925,099

[22] Filed: Sep. 8, 1997

[51] Int. Cl.[6] ..... A62D 3/00; B09B 1/00

[52] U.S. Cl. ..... 588/249; 405/128; 405/129; 405/267; 405/268; 405/270; 210/901

[58] Field of Search ..... 405/55, 57, 128, 405/129, 267, 268, 269, 270; 588/249, 259; 210/901

[56] References Cited

U.S. PATENT DOCUMENTS

| | | | |
|---|---|---|---|
| 4,092,536 | 5/1978 | Smith . | |
| 4,430,021 | 2/1984 | Wagner et al. | 405/129 |
| 4,624,604 | 11/1986 | Wagner et al. | 405/128 |
| 4,875,805 | 10/1989 | Gross | 405/55 X |
| 5,542,782 | 8/1996 | Carter, Jr. et al. | 405/129 |
| 5,765,965 | 6/1998 | Carter, Jr. et al. | 405/129 |
| 5,788,422 | 8/1998 | Gardner et al. | 405/129 X |
| 5,791,825 | 8/1998 | Gardner et al. | 405/129 X |
| 5,816,748 | 10/1998 | Kleiser et al. | 405/268 |
| 5,846,024 | 12/1998 | Mao et al. | 405/129 |
| 5,890,840 | 4/1999 | Carter, Jr. | 405/129 |

FOREIGN PATENT DOCUMENTS

P3604940 2/1986 Germany .

*Primary Examiner*—George Suchfield
*Attorney, Agent, or Firm*—Thorpe North & Western

[57] ABSTRACT

An apparatus for constructing an underground containment barrier for containing an in-situ portion of earth. The apparatus includes an excavating device for simultaneously (i) excavating earthen material from beside the in-situ portion of earth without removing the in-situ portion and thereby forming an open side trench defined by opposing earthen sidewalls, and (ii) excavating earthen material from beneath the in-situ portion of earth without removing the in-situ portion and thereby forming a generally horizontal underground trench beneath the in-situ portion defined by opposing earthen sidewalls. The apparatus further includes a barrier-forming device attached to the excavating device for simultaneously forming a side barrier within the open trench and a generally horizontal, multi-layer barrier within the generally horizontal trench. The multi-layer barrier includes at least a first layer and a second layer.

65 Claims, 3 Drawing Sheets

MULTI-LAYER WASTE CONTAINMENT BARRIER

CONTRACTUAL ORIGIN OF THE INVENTION

The United States has rights in this invention pursuant to Contract No. DE-AC07-94ID13223 between the U.S. Department of Energy and Lockheed Martin Idaho Technologies Company.

BACKGROUND OF THE INVENTION

1. Field of the Invention

The present invention relates generally to a device and method for building an underground barrier. More particularly, this invention is directed to constructing a containment barrier underneath and around a hazardous waste site or municipal landfill.

2. Background Art

It is often necessary to form a containment barrier around a hazardous waste site to stop or prevent the migration of contaminants into the nearby soil and water tables. The containment barrier must prevent the migration of contaminants both horizontally and vertically away from the waste site. Therefore, a properly constructed containment barrier may be compared to a huge bathtub, with the hazardous waste contained within four side walls and a generally horizontal floor.

A present method is to physically remove the hazardous waste and haul it to a permitted storage facility. However, such method is costly, impractical, and dangerous. Digging up sites with buried drums, radioactive dusts, or other airborne wastes may actually release the contaminants, spreading them into the atmosphere and through the soil.

In response, researchers at Halliburton Nus Environmental Corp. have developed an apparatus and method to place a containment barrier around a hazardous waste site, as shown in International Publication Nos. WO 94/19547 and WO 93/00483. The Halliburton system uses a row of high pressure jets to shoot a slurry into the soil surrounding a hazardous waste site, somewhat liquefying the surrounding soil. The slurry cuts a path through the soil as it intermixes with the liquefied soil. Gravity and/or mechanical means pull the row of high pressure jets through the mix of liquefied soil and slurry. The liquified soil and slurry then harden into a protective barrier.

Although the Halliburton system has promise for some applications, it has several shortcomings that limit its use. First, the use of hydraulic jets may introduce liquids that can further spread contaminants. Second, because the system uses the same slurry for both cutting and mixing, in many applications there may be an imbalance between the amount of slurry needed for cutting and the amount of slurry needed for hardening the soil. Third, the hydraulic jets may only work in sandy or soft soils and may not work in rocky or hard soils.

Fourth, in the Halliburton system, the slurry is not controlled as it is deposited. Since the slurry mixes with the liquefied soil, the strength of the barrier depends on the soil composition encountered. Too little slurry may be deposited where the soil is easily cut. Excess slurry may be deposited where the soil is difficult to cut. Weak spots will form in the containment barrier if the soil contains air cavities or mixed pockesuch weak spots is unpredictable. Those using the Halliburton system have no way of knowing when and where such weak spots will be.

OBJECTS AND SUMMARY OF THE INVENTION

An object of the invention is to provide a means for building a multi-layer containment barrier for a hazardous waste site.

Another object of the invention, in accordance with one aspect thereof, is to provide a means for building a horizontal containment barrier under a hazardous waste site without disturbing any buried waste.

A further object of the invention is to provide a less expensive and simpler means for building a containment barrier for a hazardous waste site.

An additional object of the invention, in accordance with one aspect thereof, is to provide a means for simultaneously building the sides and the horizontal floor of a containment barrier.

A further object of the invention is to provide a containment barrier having enhanced, reinforced strength.

An even further object of the invention is to provide a containment barrier capable of resisting radiation and other waste pit contaminants.

Still another object of the invention, in accordance with one aspect thereof, is to provide a containment barrier capable of chemically immobilizing contaminants and inhibiting movement of said contaminants through the barrier by chemical means.

The above objects and others not specifically recited are realized in a specific illustrative embodiment of an apparatus for constructing an underground containment barrier for containing an in-situ portion of earth. The apparatus includes an excavating device for simultaneously (i) excavating earthen material from beside the in-situ portion of earth without removing the in-situ portion and thereby forming an open side trench defined by opposing earthen sidewalls, and (ii) excavating earthen material from beneath the in-situ portion of earth without removing the in-situ portion and thereby forming a generally horizontal underground trench beneath the in-situ portion defined by opposing earthen sidewalls. The apparatus further includes a barrier-forming device attached to the excavating device for simultaneously forming a side barrier within the open trench and a generally horizontal, multi-layer barrier within the generally horizontal trench. The multi-layer barrier includes at least a first layer and a second layer.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
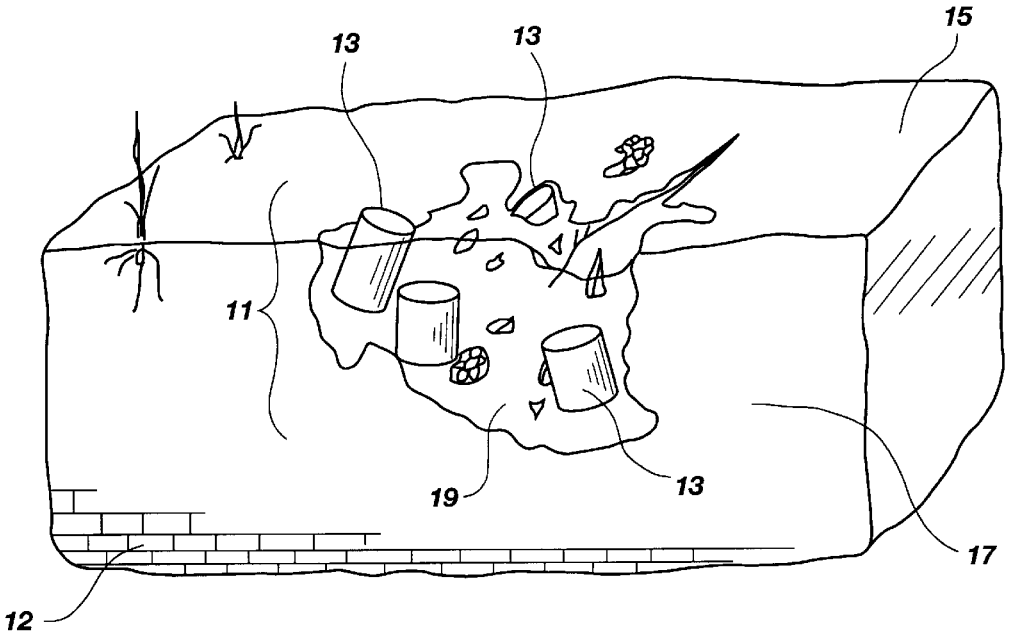
FIG. 1 is a perspective view of a piece of ground contaminated by hazardous waste.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated apparatus, and any additional applications of the principles of the invention as illustrated herein, which would normally occur to one skilled in the relevant art and possessed of this disclosure, are to be considered within the scope of the invention claimed.

Applicants have discovered that hazardous waste can be contained more effectively by encapsulating the waste site with a large container, preferably made from a material having emplacement and curing properties the same as, or similar to, fluidic or flowable grout or other cementitious material, without moving or disturbing the waste. Conventional methods of removing the waste to some other site, or forming a containment barrier by intermixing grout with the native soil surrounding the waste, are less effective in minimizing the risks associated with disturbing the waste and failing to seal the waste properly. Applicants' method subsists in actually forming a containment barrier beneath and around the waste site to encapsulate the waste with independently-formed barrier walls, without moving or even disturbing the waste, and preferably without using the native surrounding soil as part of the barrier-forming material.

The further concepts of the present invention include a preferred method for containing an in-situ waste site disposed within earthen material, said method comprising the steps of:

(a) excavating a generally horizontal trench beneath the in-situ waste site substantially without disturbing said in-situ waste site and thereby forming a generally horizontal underground trench defined by opposing earthen sidewalls;

(b) forming a generally horizontal barrier within the horizontal trench, preferably as the horizontal underground trench is excavated; more specifically, an excavation device is advanced underground beneath the waste site and as excavated material is removed to form a section of the trench and delivered upwardly to the surface, curable barrier material is injected to replace the soil—a barrier-forming injection apparatus follows the underground excavation device such that underground soil is incrementally removed and replaced with the barrier-forming material until a continuous horizontal underground barrier of sufficient length is formed;

(c) excavating side trenches continuously surrounding the entire in-situ waste site such that said side trenches are disposed in communication with the horizontal trench;

(d) forming interconnected side barriers within the side trenches such that said side barriers continuously surround the waste site and form a continuous upper perimeter;

(e) interconnecting the side barriers with the horizontal barrier such that said horizontal and side barriers cooperatively form a one-piece unitary barrier enclosure.

The method described above may be further augmented by:

(f) forming an upper barrier cover over the waste site and interconnecting said barrier cover with the side barriers, said upper barrier cover being of a size sufficient to span all opposing side barrier portions, and (g) securing said upper barrier cover along the continuous upper perimeter of the side barriers to thereby encapsulate the waste site.

Referring now to FIG. 1, a waste site 11 contains drums 13 filled with hazardous waste, both on the surface 15 and buried deep under the ground 17. Contaminants 19, leaking from the drums 13, threaten to migrate into a water table 12 or to otherwise contaminate the environment.

Figure 2:
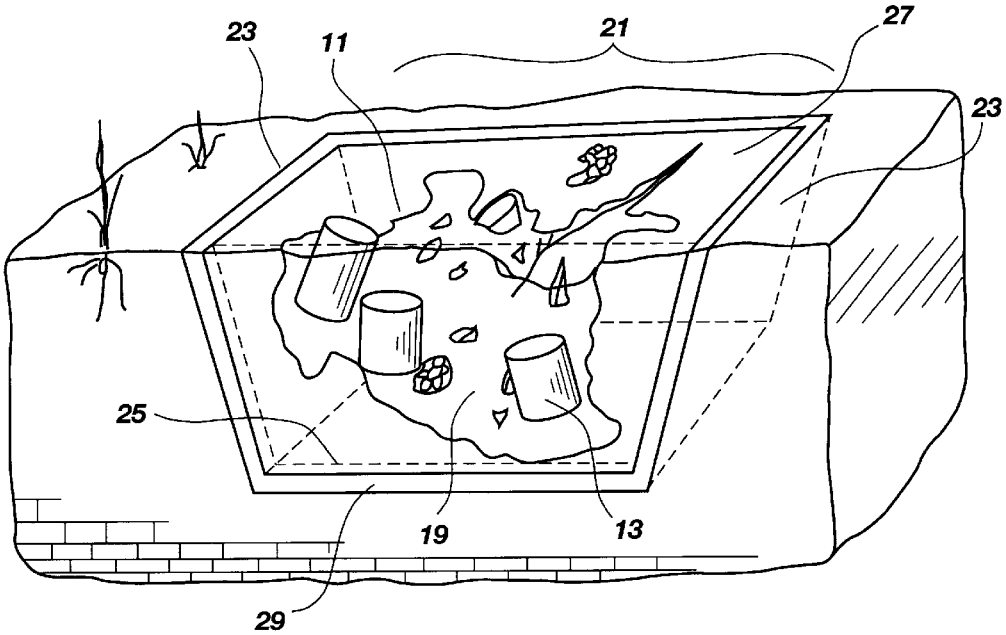
FIG. 2 is a perspective view of the piece of ground with the hazardous waste contained by a protective ground barrier.
Figure 3:
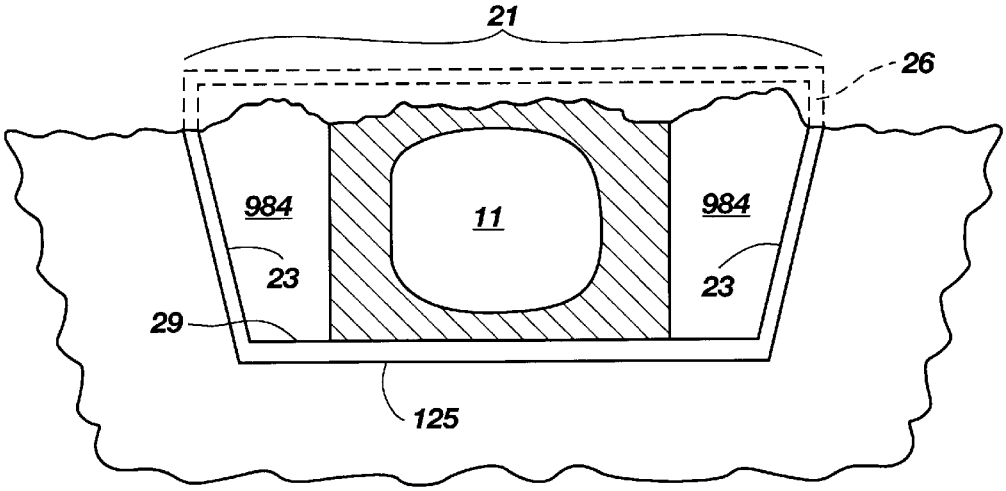
FIG. 3 is a cross-section view of a buried hazardous waste pit contained by one embodiment of a protective ground barrier built by a barrier placement machine.
Figure 4:
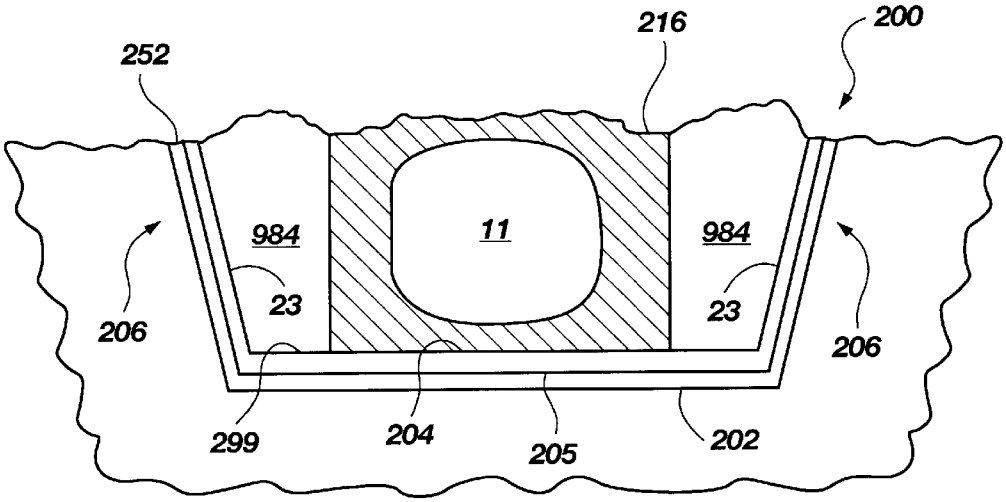
FIG. 4 is a cross-section view of a buried hazardous waste pit contained by a protective, multi-layer ground barrier made in accordance with the principles of the present invention.

As shown in FIGS. 2–4, the invention provides a way to build a containment barrier 21 (200 in FIG. 4). The invention places a floor or horizontal barrier 29 (or multi-layer floor 29*a* as in FIG. 4) without digging up the drums 13 or otherwise disturbing the contaminated soil of the waste cite 11. Side barriers 23 (206 in FIG. 4) of the containment barrier 21 may be made using conventional methods and may be interconnected to the horizontal barrier 29 (29*a* in FIG. 4). However, in one embodiment of this invention, the floor 29 and the sides 23 are built simultaneously.

The waste site 11 may be completely encapsulated by forming an upper barrier cover. Referring now to FIG. 3, an upper barrier cover 26 is shown in phantom line and is interconnected with the side barriers 23 and the front and rear barriers 25 and 27 (shown in FIG. 2, with the front barrier 25 shown in phantom line).

Figure 6:
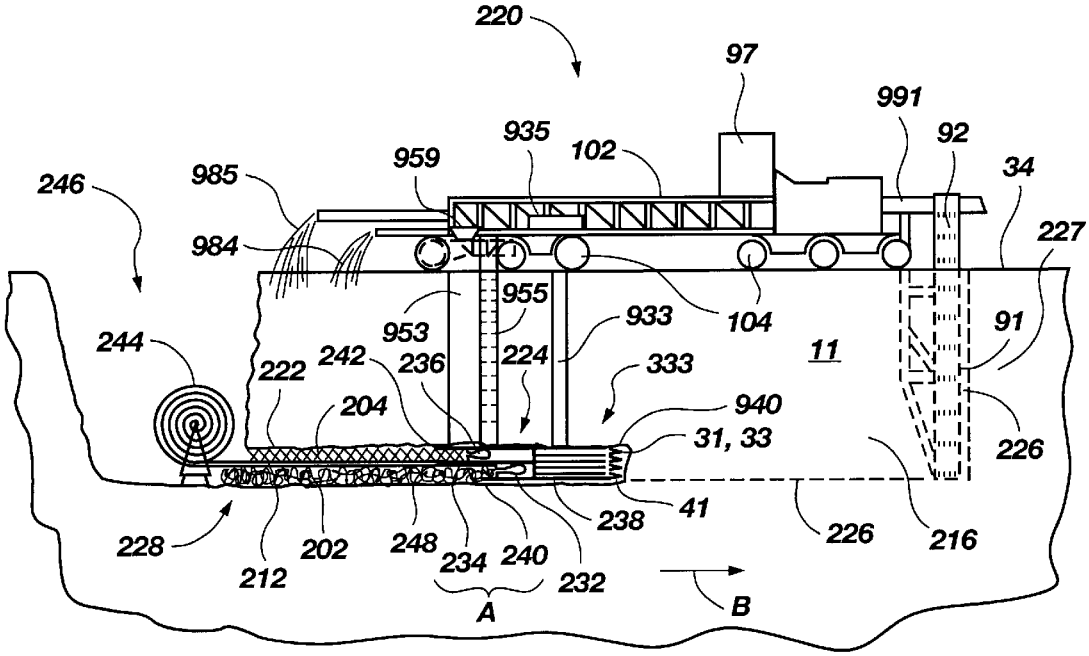
FIG. 6 is shown a barrier placement machine, made in accordance with the principles of the present invention.

Referring now to FIG. 6, there is shown schematically a barrier placement machine 220, adapted to form a generally horizontal, multi-layer barrier 228 within a generally horizontal trench 222, said multi-layer barrier 228 having at least a first layer 202 and a second layer 204. However, the concept of the barrier placement machine 220 may of course be utilized to form a single-layer underground barrier as well, such as barrier 29 in FIGS. 2–3.

The conceptual workings of the barrier placement machine 220 contemplate advancing a main frame support structure 102 along the surface 34 by advancing means 104. The support structure 102 carries soil cutter and grout injector assembly 333 which is placed initially in the bottom of a suitably sized beginning trench 246. As the advancing means 104 advances the support structure 102 horizontally in the direction of arrow B, the soil cutter and grout injector assembly 333 is also advanced in that same direction and proceeds to excavate a horizontal underground trench 940 and construct therein the horizontal barrier 228. The soil cutter and grout injector assembly 333 operate to excavate earthen material 985 from beneath the in-situ portion of earth 216 without removing said in-situ portion.

For example, the soil cutter and discharge device 31,33 may include cutting teeth 31 (or any suitable soil cutter) and soil removing cups 33 (not detailed in the drawings, but indicated schematically in FIG. 6 and therefore understandable to one of ordinary skill in the relevant art), for removing the excavated soil 985 as described above. A soil conveyor 933 carries excavated soil upwardly, in any manner and structure known to those of ordinary skill in the relevant art, and discharges the soil 985 above ground where it lies conveniently accessible for testing if desired. As an incremental section of underground soil is excavated and removed, grout or other curable barrier material is injected in the soil's place by an injector means to form the underground horizontal barrier, such as barrier 228 (FIG. 6, multi-layer) or barrier 29 (FIGS. 2–3, single layer).

Unlike the Halliburton system discussed above in The Background Art section, the barrier placement machine 220 includes a soil cutter and discharge device 31,33 which is separate from a grout injection system 224. Therefore, only the grout needed for the containment barrier is introduced into the soil. There is less disturbance of the soil and the present invention introduces no excess liquid that may further spread contaminants. Further, different grout compositions may be used as needed to contain different contaminants present in the waste site.

However, this invention further includes an embodiment where the soil is not removed but mixed directly with the grout. The removing cups 33 could be detached so the broken up soil remains in the void 41 created by the cutting teeth 31, and the broken soil is then pressure grouted such that the barrier 29 (FIG. 2) is formed as a continuous barrier of earth and grout.

In addition to grout, this assembly may dispense any material that initially flows as a slurry into an open space, yet over time cures into a solid mass having generally the shape of the open space. The material may include any cementitious material, latex polymer cement, bentonite clay slurry, hot wax (such as paraffin wax), hot asphalt, hot polyethylene, gelled water, any organic epoxy or any other suitable compound. Additionally, the grout itself may contain additional radiation shielding components or biological and chemical neutralizing components.

The concept of forming the single underground layer 29 as shown in FIG. 2 is augmentable to allow two or more layers of different materials to be placed simultaneously. In reference to FIG. 6, a stack of two injection chambers can be used to dispense two different barrier-forming materials within the void as the barrier placement machine 220 advances. Thus, a layer of material other than grout may be added at the same time as the grout layer, or two non-grout layers may be formed, or any suitable layer combination. A possible containment barrier produced by this invention would include a cementitious layer and one or more preferably plastic layers. The cementitious layer would provide the strength and support while the plastic would add leak protection, especially if cracks develop in the cementitious layer.

FIG. 3 shows a cross-section view of the contained hazardous waste site 11. Grout side walls 23 and a grout floor 125 enclose the hazardous waste pit 11, along with the upper barrier cover 26. The machine 220 (FIG. 6) includes a pair of side-trench excavators disposed on the frame 102, one of which is shown as item 91 in FIG. 6 with the understanding that a similar or identical side-trench excavator is located adjacent the one shown.

The side-trench excavator 91 includes a continuous revolving soil cutter and conveyor, in accordance with any method or structural apparatus known to those having ordinary skill in the relevant art, for cutting in the direction of arrow B and therefore into soil 227 and removing the soil upwardly onto a trench excavator conveyor 991 to produce side trench 226. Grouting machinery, including a sidewall traveling pan 953 and sidewall consolidator 955, are used to form the side barriers (23 in FIGS. 2–3, 206 and 214 in FIGS. 4–5). The soil excavated to form the side trench 226 is replaced as soil 984 in a back fill against the newly formed side barrier.

Referring now more particularly to FIGS. 4–7, a key aspect in accordance with the principles of the present invention is shown therein. Applicants have found that utilizing a multi-layer barrier provides several distinct advantages, including enhanced inhibition of seepage from the contained waste, and increased structural capacity of the barrier.

In FIG. 4 is shown a double layer containment barrier, designated generally at 200. The barrier 200 includes a first layer 202, and a second layer 204 disposed atop the first layer 202. Side portions 206 of the barrier 200 are shown in double, multi-layer construction, but may alternatively be embodied in a single layer construction.

Figure 5:
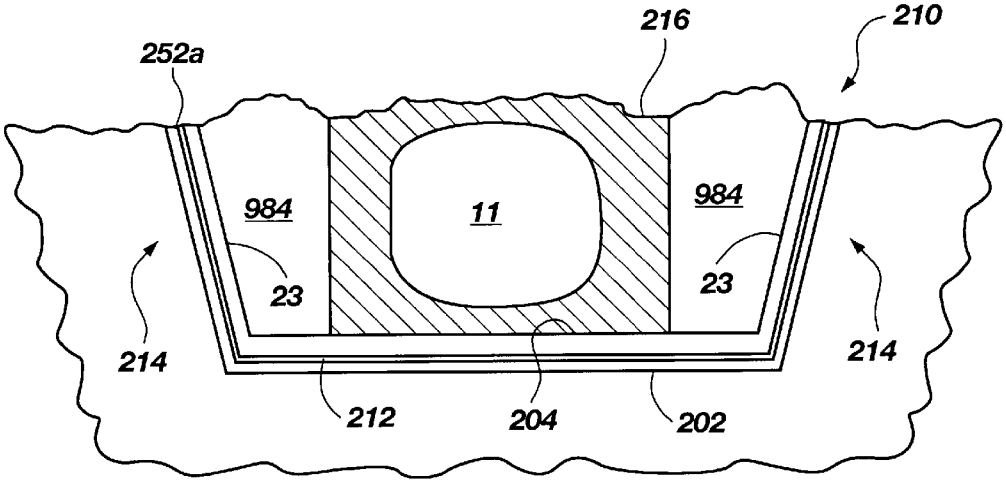
FIG. 5 is a cross-section view of a buried hazardous waste pit contained by a protective, triple-layer ground barrier made in accordance with the principles of the present invention.

In FIG. 5 is shown a triple layer containment barrier, designated generally at 210. The barrier 210 includes the same first layer 202 and second layer 204 as in FIG. 4, as well as a third layer 212 sandwiched between the first and second layers 202 and 204. Side portions 214 of the barrier 210 are shown in triple, multi-layer construction, but may alternatively be embodied in a single layer construction.

The first, second and third layers 202, 204 and 212 may comprise any suitable material for the intended purpose of containing the buried waste pit 11. For example, any or all of the layers 202, 204 and 212 may comprise grout or some other cementitious material, or alternatively sand or clay. Further, one or more of the layers, preferably the third or middle layer 212, may comprise a homogenous, non-reinforced layer. Preferably at least one of the layers is formed from an at least partially synthetic material. For example, the third layer 212 may comprise a high-performance polyethylene membrane, or a fiber reinforced composite layer, or a Teflon(tm) mesh, or any other suitable mesh material. The third layer 212 is preferably thinner than either of the first or second layers 202 and 204.

The principles of the present invention extend to cover any apparatus or method capable of constructing a multi-layer barrier around an in-situ portion of earth, such as in-situ portion 216 that contains the buried waste pit 11. Referring now to FIG. 6, there is shown a barrier placement machine 220. For example, the machine 220 includes the operator's cab 97, the cutting chain and grout injector assembly 333 including cutter teeth 31 and discharge paddles 33, the grout receiving conveyor 959, the sidewall traveling pan 953, the sidewall consolidator 955, a side trench excavator 91, soil conveyor 933, and advancing means 104 for moving the entire machine 220. The machine 220 is depicted in FIG. 6 in schematic form, and may include all other components necessary 79 for its operation, as understood by those of ordinary skill in the relevant field. For example, the grout may be pumped through pipes (not shown) extending from the barrier placement machine 220, through the side trench 226, to the cutting chain and grout injector assembly 333, as is understood by those of ordinary skill in the relevant field.

As the barrier placement machine 220 moves forward, a trench excavator 91 digs a side trench shown in phantom line at 226. The trench excavator 91 carries the excavated soil 984 up out of the ground and dumps it on the trench excavator conveyor 991, which carries the soil backwardly along the machine 220. Grout or other suitable barrier forming material is then placed within the side trench 226 by the sidewall traveling pan 953 and the sidewall consolidator 955, along with any other necessary grout injecting devices known to those of ordinary skill, to form the side barrier (shown as a multi-layer barrier 206 and 214 in FIGS. 4–5, but may also comprise a single-layer barrier). The trench excavator conveyor 991 dumps the soil 984 behind the barrier placement machine 220, refilling the side trench 226. Simultaneously, the cutting chain and grout injector assembly 333 and soil conveyor 933 operate to excavate earthen material 985 from beneath the in-situ portion of earth 216 without removing said in-situ portion, and discharges the soil 985 above ground as shown in FIG. 6 where it lies conveniently accessible for testing if desired.

The machine 220 thus includes excavating means 91, 31, 33, 933 and 991 for simultaneously (i) excavating earthen material 984 from beside the in-situ portion of earth 216 without removing said in-situ portion 216 and thereby forming an open side trench 226 defined by opposing earthen sidewalls, and (ii) excavating earthen material 985 from beneath said in-situ portion of earth 216 without removing said in-situ portion 216 and thereby forming a generally horizontal underground trench 222 beneath said in-situ portion 16 defined by opposing earthen sidewalls.

The machine 220 further includes a barrier-forming means 953, 955 and 224 attached to the excavating means 31, 33 and 91 for simultaneously forming a side barrier 206 (as in FIG. 4) within the open trench 226 and a generally horizontal, multi-layer barrier 228 within the generally horizontal trench 222, said multi-layer barrier 228 having at least a first layer 202 and a second layer 204. Regarding the side barrier 206 (as in FIG. 4), the sidewall travel pan 953 lowers grout into the side trench 226 with a sidewall consolidator 955 where the grout is shaped into an upwardly extending, preferably vertical wall.

Regarding the horizontal, multi-layer barrier 228, the means 224 of the machine 220 constitutes a horizontal barrier forming means for forming at least a portion of the second layer 204 simultaneously with forming at least a portion of the first layer 202. More specifically, the horizontal barrier forming means 224 includes: a first injector means 232 for injecting a first material for forming the first layer 202 in the horizontal trench 222; a means for placing an intermediate shield 234 over the material for the first layer 202; a second injector means 236 for injecting a second material for forming the second layer 204 onto the intermediate shield 234; and a frame means 238 to which the intermediate shield 234 is attached for removing the intermediate shield 234 from between the first and second material forming the first and second layers 202 and 204. Since the frame means 238 is coupled to the structure 102, the attached shield 234 is moved between the first and second layers 202 and 204 as the machine 220 advances. The intermediate shield 234 is disposed between the first and second injection means 232 and 236 and, as an extension of the frame 238, is advanced horizontally between the first and second layers 202 and 204 as they are formed, as the advancing means 104 advances the machine 220. As indicated above, grout may be pumped through pipes extending from the barrier placement machine 220, through the side trench 226, to the horizontal barrier forming means 224, and to the first and second injector means 232 and 236, as is understood by those of ordinary skill in the relevant field.

Since the horizontal excavating means 31, 33 and the first and second injector means 232 and 236 are advanced along the underground horizontal trench 222, the advancing means 104 and the frame support structure 102 cooperate as advancing means for simultaneously advancing the excavating means and the barrier-forming means such that at least a portion 31, 33 of the excavating means and at least a portion 232, 236 of the barrier-forming means are advanced beneath the in-situ portion of earth 216.

It is to be understood that the machine 220 may be utilized to form a two-layer horizontal barrier as illustrated in FIG. 4, or a three-layer horizontal barrier as illustrated in FIG. 5, for example. The machine 220 may include a stack of injector means of any desired number, two being shown in FIG. 6 as items 232 and 236. If, alternatively, four injector means were disposed in a stacked arrangement, then a four-layer horizontal barrier could be thereby formed by simply injecting a clay slurry, grout, or other material to form each layer. Alternatively, a stack of three injector means, with two layers from a roll of material disposed between each injector means in the same or similar manner as depicted by the roll 244, could be used to form a five-layer horizontal barrier.

With respect to the two-layer barrier 200 as in FIG. 4, a roll of pre-formed barrier material (item 244 in FIG. 6, or item 250 in FIG. 7) would not be used. The first and second layers 202 and 204 would be formed simultaneously, and material for the second layer 204 would preferably be dispensed from the second injection means 236 directly on top of the intermediate shield 234, to prevent any intermixing between the first and second layers 202 and 204 during their initial cure cycles. Accordingly, the intermediate shield 234 is preferably sufficiently long in a lateral dimension A, and is advanced in a direction B at a sufficiently slow rate, such that the first and second layers 202 and 204 are cured to a degree sufficient to prevent intermixing therebetween when the shield 234 moves to permit contact between said first and second layers 202 and 204. These same principles and procedures may be used to form three-layer, four-layer, or five-layer horizontal barriers, or any other number of layers.

Alternatively, users might prefer to induce some degree of interaction between the first and second layers 202 and 204. The rate of movement of the shield 234 may be sufficiently fast, and its length in the dimension A might be sufficiently short, to permit contact between the layers 202 and 204 in an uncured state sufficient to allow a chemical reaction at an interface 205 (shown in FIG. 4) between those layers, perhaps to produce a chemical bond at the interface. The barrier forming materials for constructing the layers 202 and 204 may be selected to react at the interface 205 in a manner to produce a chemically different material than the initial material used in the layers 202 and 204.

The first and second injector means 232 and 236 are contained within first and second chambers 240 and 242, respectively. The intermediate shield 234 thus operates as a carrying member coupled to the chambers 240 and 242. The third, middle layer 212 begins as a dispensable, pre-formed roll 244 of barrier material that resides in a suitably sized trench 246. The roll 244 of barrier material includes a first end 248. Any suitable attaching means known to those of ordinary skill in the art may be used for attaching the first end 248 of the roll 244 of barrier material to the intermediate shield 234, such that barrier material is withdrawn from the dispensable roll 244 as the machine 220 advances. In such manner the roll of material 244, which might comprise a high performance material such as polyethylene or any suitable material, is pulled between the first and second layers 202 and 204 as the machine 220 advances. In this embodiment, the barrier material of the roll 244 preferably has sufficient strength to be pulled between the first and second layers 202 and 204 without substantial tearing.

Figure 7:
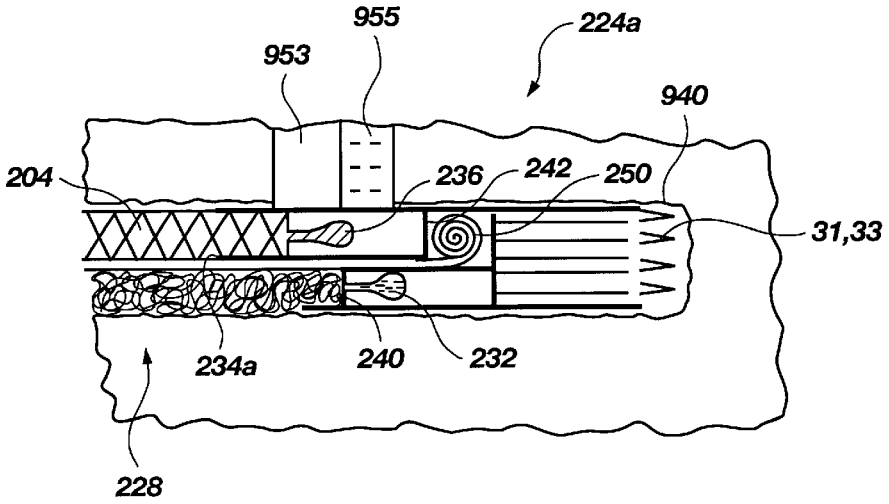
FIG. 7 is an alternative embodiment of the barrier placement machine of FIG. 6.

An alternative embodiment is depicted in FIG. 7. A dispensing means 250 comprises a pre-formed roll of barrier material rotatably disposed between the horizontal digging means 31, 33 and the chambers 240, 242. The second injector means 236 is positioned to inject the second layer 204 on top of an intermediate shield 234*a* such that said shield 234 separates the second layer 204 and the pre-formed layer 212 as said second layer 204 and said pre-formed layer 212 are being respectively injected and dispensed. The intermediate shield 234*a* thereby operates as a retaining plate.

In the embodiment of FIG. 7, the pre-formed roll 250 must of course be small enough to fit within the horizontal barrier forming means 224*a*. Since the length of many waste pits exceeds 100 feet, the internally placed roll 250 would probably not contain a sufficient length of material, and would be periodically replaced with additional rolls of material to complete the third, middle layer 212. The roll 250 could be removed and replaced through the side trench 226.

If desired, a sensing means (now shown) may be disposed on the barrier material of the rolls 244 and 250 for sensing hazardous materials, for example. In this manner, any desired sensing means can be deployed between the first and second layers 202 and 204 by being incorporated into the barrier material forming the roll 244 or the roll 250.

The trench excavator 91 and horizontal digging means 31, 33 are preferably configured and arranged for forming the side trench 226 such that it is disposed in communication with the horizontal trench 222. Additional digging means known in the art are used to dig the initial, beginning trench 246 and a final trench (not shown) located on the opposite side of the in-situ portion of earth 216 as the beginning trench 246. As such, the invention comprises means for forming a pair of side trenches adjacent the in-situ portion of earth 216 such that said side trenches are disposed in communication with the horizontal trench 222.

Any suitable means for forming a side barrier in the trench 246 and in the oppositely located final trench (not shown) may be utilized. As such, the invention includes means for forming side barriers (including barrier 206 in FIG. 4 or 214 in FIG. 5, as well as side barrier in the trench 246 and the oppositely positioned final trench) within the plurality of side trenches and interconnecting the side barriers (206 or 214) with the horizontal, multi-layer barrier 228 such that said horizontal and side barriers cooperatively form a one-piece unitary barrier enclosure.

Most preferably, the interconnected side trenches continuously surround the in-situ portion of earth 216, such that the interconnected side barriers continuously surround the in-situ portion of earth 216 and form an upper perimeter 252 (FIG. 4) or 252*a* (FIG. 5).

Applicants note than any of the apparatus or method described herein and shown in any of the FIGS. 1–7 may be optionally incorporated into a single layer barrier forming machine, as an adaptation of the multi-layer barrier forming machine 220 of FIG. 6.

In accordance with the above, a preferred method for constructing an underground containment barrier for containing an in-situ portion of earth 216 comprises the steps of:

(a) excavating a generally horizontal trench 222 beneath the in-situ portion of earth 216 substantially without disturbing said in-situ portion 216 and thereby forming a generally horizontal underground trench 222 beneath said in-situ portion 216 defined by opposing earthen sidewalls; and (b) forming a generally horizontal, multi-layer barrier 228 within the horizontal trench 222 comprising a first layer 202 and a second layer 204 disposed above said first layer.

The above description contemplates a physical containment of contaminants and waste by simply encapsulating them with a barrier, the barrier being preferably impermeable. A further aspect of the invention subsists in a chemical containment of the contaminants, preferably through use of a permeable barrier.

For example, the layers 202 and 204 of the multilayer barrier 29*a* in FIG. 4 could be made of a permeable material. At least one of the layers contains therein chemical means for (i) chemically immobilizing contaminants disposed in the in-situ portion of earth and (ii) inhibiting movement of said contaminants through said at least one of the layers. Contaminants such as radio nuclides, metals and organic materials could be contained in this manner.

It is contemplated that the chemical means could either comprise a property of the material of the layer, such as might be accomplished by forming the layer from bentonite, hematite, or apatite, or the chemical means could comprise an additive to the layer, such as a zeolite, or a clay additive of bentonite, hematite or apatite. The layers could also comprise any other suitable crystalline inorganic material.

Such materials, and other known to those of ordinary skill in the art, may operate to permit ground water movement through the layer but chemically immobilize certain contaminants in the manner of a sieve, through precipitation, ion exchange, or adsorption. The permeable layer would, for example, form a chemical bond with certain contaminants and thereby inhibit the release of said contaminants into the environment. The contaminants become immobilized within the barrier itself.

A multi-layer barrier may thus be constructed such that only some, or all, of the layers include a chemical means for immobilizing the contaminants in the soil. Different materials for the layers (or in the alternative different chemical additives) may be used for the different layers, such that certain layers will immobilize some contaminants but not others. For example, the chemical means of the first layer may be capable of immobilizing a first contaminant but not a second, third or fourth contaminant, and the chemical means of the second layer may be capable of immobilizing a second contaminant but not the first, third or fourth contaminant, and the chemical means of the third layer may be capable of immobilizing a third contaminant but not the first, second or fourth contaminant, and the chemical means of the fourth layer may be capable of immobilizing a fourth contaminant but not the first, second or third contaminant.

Alternatively to chemical containment device, the invention may instead comprise permeable layers designed to contain therein degrading means for chemically degrading contaminants disposed in the in-situ portion of earth. The degrading means may comprise an iron-based media capable of chemically reducing the contaminants to non-toxic components, or any other suitable agent for reactively destroying contaminants.

It is to be understood that the chemical containment features contemplated above (such as through precipitation, ion exchange, or adsorption), and the chemical degradation features, could possibly be included in combination with impermeable layers as well, to provide a physical containment as well as a chemical containment.

Thus, multiple layers can be designed to address containment of different classes of contaminants of concern. The barrier layers could be composed of either soils, clays, crystalline inorganics or other material (or a combination of these) that will react with the contaminants to either immobilize (through precipitation, ion exchange or adsorption) or destroy (chemically decompose) and prevent or mitigate the releases of contaminants to the environment to an acceptable level. Additives (such as zeolite, bentonite, other chemical reagents) to a layer of the underground horizontal barrier could enhance the capability of the barrier to immobilize or destroy contaminants that begin migrating through the permeable barrier.

A further aspect of the invention contemplates a self-healing layer, which could repair itself of fractures produced by earthquakes or other forces. For example, at least one of the layers of the multi-layer barrier may comprise a self-healing layer having sufficient flexibility and softness to reform and reseal fractured portions of itself back together.

The invention of FIGS. 6–7 may further comprise cutting means for simply cutting earthen material from beneath the in-situ portion of earth 216 without removing said in-situ portion 216 and thereby forming a loosened section of soil beneath the in-situ portion. The soil cutter and discharge device 31,33 would simply be modified to not include any soil removing cups 33 (not detailed in the drawings, but indicated schematically in FIG. 6 and therefore understandable to one of ordinary skill in the relevant art), and one of the first and second injector means 232 and 236 would simply inject uncured slurry into the loosened soil to thereby cause the slurry and loosened soil to intermix and cure to form at least one of the layers of the multi-layer barrier 228. The cutter 31 would simply cut up the soil without removing it. In the alternative, the soil cutter and discharge device 31,33 could simply be designed to remove only part of the loosened soil, thereby permitting the injected slurry to intermix with the remaining loosened soild to fill the void from the removed soil and cure to form a generally horizontal barrier.

For example and by illustration only, the slurry could be injected under sufficient pressure to cause intermixing between the soil and the slurry. The term "slurry" as used herein shall refer broadly to any suitable aqueous material which is sufficiently curable to form a rigid and hard barrier.

It is to be understood that the inventive combinations described herein are applicable to a wide variety of uses. The inventive concepts of excavating surrounding trenches around an in-situ waste site without removing the waste site, and forming barriers within the trenches without relying on the native soil to form the barrier material, are broadly applicable. These concepts may be used in building construction, canal construction, leach mining and tunnel construction, in various applicable ways understandable to those of ordinary skill in the art. The concepts herein may also be used as a secondary containment system to surround an existing containment structure such as an underground tank. They could further be used to create a subjacent reinforcing barrier beneath a building foundation, or to repair a leaking pond or channel or to contain environmental spills, munitions, or unexploded ordinance. The installation and reinforcement of pipe may also be served by the invention combinations described herein. A containment well barrier could also be formed with the concepts of the present disclosure. The phrase "in-situ" as used herein shall be broadly construed to refer to objects or cumulations of objects which remain situated in their original position. The adjective "earthen", as used herein in phrases such as "earthen material" or "earthen sidewalls", shall be construed broadly herein to refer to anything composed at least partially of earth, including, but not limited to, soil, rock, gravel, clay, dirt, sand and the like. As such, the phrase "in-situ portion of earth" as used herein shall be construed broadly to include waste dumps as well as undisturbed earth.

The term "contain" as used herein shall be construed broadly to include the concept of any degree of containment or structural impedance, and shall therefore not be limited in meaning to the concept of complete encapsulation. For example, a single, unattached horizontal layer disposed beneath a waste site which prevents, or at least inhibits seepage from the waste site, can be described as providing containment to the waste site. In that sense, such a horizontal layer does indeed contain the waste site.

The phrase "generally horizontally" as used herein shall be construed broadly to refer to a direct horizontal direction as well as an at least partial horizontal direction. For example, an underground layer that extends laterally but also at some degree of downward incline may be described as extending generally horizontally, provided the downward inclined portion defines an angle with horizontal of less than 45°.

It is also to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

We claim:

1. An apparatus for constructing an underground containment barrier for containing an in-situ portion of earth, said apparatus comprising:

excavating means for simultaneously (i) excavating earthen material from beside the in-situ portion of earth without removing said in-situ portion and thereby forming an open side trench defined by opposing earthen sidewalls, and (ii) excavating earthen material from beneath said in-situ portion of earth without removing said in-situ portion and thereby forming a generally horizontal underground trench beneath said in-situ portion defined by opposing earthen sidewalls; and barrier-forming means attached to the excavating means for forming a side barrier within the open trench and a generally horizontal, multi-layer barrier within the generally horizontal trench, said multi-layer barrier having at least a first and a second layer.

2. The apparatus as defined in claim 1, wherein the excavating means further comprises means for forming the side trench such that said side trench is disposed in communication with the horizontal trench.

3. The apparatus as defined in claim 1 wherein:

the excavating means further comprises means for forming a plurality of side trenches adjacent the in-situ portion of earth such that said side trenches are disposed in communication with the horizontal trench;

the barrier-forming means further comprises means for forming side barriers within the plurality of side trenches and interconnecting the side barriers with the horizontal, multi-layer barrier such that said horizontal and side barriers cooperatively form a one-piece unitary barrier enclosure.

4. The apparatus as defined in claim 3 wherein:

the excavating means further comprises means for forming interconnected side trenches that continuously surround the in-situ portion of earth;

the barrier-forming means further comprises means for forming interconnected side barriers within the interconnected side trenches such that said side barriers continuously surround the in-situ portion of earth and form an upper perimeter.

5. The apparatus as defined in claim 1, wherein the barrier-forming means further comprises means for forming at least a portion of the second layer simultaneously with forming at least a portion of the first layer.

6. The apparatus as defined in claim 5, wherein the barrier-forming means further comprises:

means for injecting a first material for forming the first layer into the horizontal trench;

means for placing an intermediate shield over the material for the first layer;

means for injecting a second material for forming the second layer onto the intermediate shield; and means for removing the intermediate shield from between the first and second material.

7. The apparatus as defined in claim 6, wherein (i) the intermediate shield is sufficiently long in a lateral dimension, and (ii) the means for removing comprises means for advancing the intermediate shield in a lateral direction at a sufficiently slow rate, such that the first and second layers are cured to a degree sufficient to prevent intermixing therebetween when the intermediate shield is moved to permit contact between said first and second layers.

8. The apparatus as defined in claim 6, wherein (i) the intermediate shield is sufficiently short in a lateral dimension, and (ii) the means for removing comprises means for advancing the intermediate shield in a lateral direction at a sufficiently fast rate, such that the s first and second layers remain uncured to a degree sufficient to permit a chemical reaction at an interface between those layers.

9. The apparatus as defined in claim 8, wherein the chemical reaction produces a chemical bond at the interface.

10. The apparatus as defined in claim 8, wherein the chemical reaction produces a chemically different material than the material used in the first and second layers.

11. The apparatus as defined in claim 1, wherein the barrier-forming means further comprises means for forming a multi-layer horizontal barrier comprising at least first, second and third layers within the generally horizontal trench.

12. The apparatus as defined in claim 11, wherein the second layer comprises a middle layer sandwiched between the first and third layers, said middle layer being thinner than said first and third layers.

13. The apparatus as defined in claim 1, wherein the barrier-forming means further comprises means for forming at least one of the two layers from an at least partially synthetic material.

14. The apparatus as defined in claim 11, wherein one of the layers comprises a high-performance polyethylene membrane.

15. The apparatus as defined in claim 11, wherein one of the layers comprises a homogenous, non-reinforced layer.

16. The apparatus as defined in claim 11, wherein one of the layers comprises a fiber reinforced composite layer.

17. The apparatus as defined in claim 11, wherein one of the layers comprises a mesh material.

18. The apparatus as defined in claim 1, wherein the barrier-forming means comprises an upper chamber having upper injecting means for injecting an upper barrier-forming material, and a lower chamber disposed beneath the upper chamber and having a lower injecting means for injecting a lower barrier-forming material beneath said upper barrier-forming material.

19. The apparatus as defined in claim 18, further comprising:

advancing means for simultaneously advancing the excavating means and the barrier-forming means such that at least a portion of the excavating means and at least a portion of the barrier-forming means are advanced beneath the in-situ portion of earth;

wherein the barrier-forming means further comprises (i) a carrying member coupled to the chambers, (ii) a dispensable, pre-formed roll of barrier material, said barrier material having a first end, and (iii) attaching means for attaching said first end of the roll of barrier material to the carrying member, such that the barrier material is withdrawn from the dispensable roll as the barrier-forming means is advanced.

20. The apparatus as defined in claim 19, wherein the carrying member comprises a plate disposed to reside between the first injection means and the second injection means for drawing the pre-formed barrier material between the first and second layers such that said pre-formed barrier material comprises a third, middle layer.

21. The apparatus as defined in claim 19, further comprising sensing means disposed on the barrier material for sensing hazardous materials.

22. The apparatus as defined in claim 18, wherein the excavating means comprises horizontal digging means disposed on the chambers for forming the generally horizontal trench, said apparatus further comprising:

advancing means for simultaneously advancing the excavating means and the barrier-forming means such that the horizontal digging means and at least a portion of the barrier-forming means are advanced beneath the in-situ portion of earth;

wherein the barrier-forming means further comprises (i) a retaining plate coupled to the chambers, and (ii) a dispensing means for dispensing a pre-formed layer of barrier material beneath the retaining plate and between the first and second layers such that said pre-formed layer comprises a middle layer sandwiched between said first and second layers.

23. The apparatus as defined in claim 22, wherein the dispensing means is disposed between the horizontal digging means and the chambers.

24. The apparatus as defined in claim 22, wherein the upper injecting means is positioned to inject the upper barrier-forming material on top of the retaining plate such that said retaining plate separates the upper barrier-forming material and the pre-formed layer as said upper barrier-forming material and said pre-formed layer are being respectively injected and dispensed.

25. The apparatus as defined in claim 22, wherein the dispensing means comprises a pre-formed roll of barrier material rotatably and removably disposed between the horizontal digging means and the chambers.

26. The apparatus as defined in claim 1, wherein the excavating means is coupled to the barrier-forming means, the apparatus further comprising:

advancing means for advancing at least a portion of the excavating means and at least a portion of the barrier-forming means simultaneously beneath the in-situ portion of earth.

27. The apparatus as defined in claim 1, wherein the barrier-forming means further comprises means for forming a multi-layer side barrier within the open trench.

28. The apparatus as defined in claim 1, wherein the excavating means includes horizontal digging means for forming the generally horizontal trench, the apparatus further comprising:

advancing means for simultaneously advancing the excavating means and the barrier-forming means;

shield means attached to the horizontally digging means for (i) moving along at least one of the earthen sidewalls of the horizontal trench as the excavating means advances, and (ii) providing support to said earthen sidewall.

29. The apparatus as defined in claim 1, wherein the barrier-forming means comprises means for forming barriers within the trenches substantially without a ny intermixing of in-situ earthen material with material of the barriers.

30. The apparatus as defined in claim 1, wherein the excavating means comprises:

at least a first endless chain; and at least a first chain driving means for advancing the first chain in continuous orbital movement.

31. The apparatus as defined in claim 30, further comprising:

a plurality of digging teeth disposed on the chain; and a plurality of excavation vessels disposed on the chain.

32. The apparatus as defined in claim 1, wherein at least one of the layers of the horizontal barrier is substantially impermeable.

33. The apparatus as defined in claim 1, wherein at least one of the layers of the horizontal barrier is permeable.

34. The apparatus as defined in claim 1, wherein at least one of the layers of the multi-layer barrier contains therein chemical means for (i) chemically immobilizing contaminants disposed in the in-situ portion of earth and (ii) inhibiting movement of said contaminants through said at least one of the layers.

35. The apparatus as defined in claim 34, wherein the chemical means comprises a property of said at least one of the layers, and wherein said layer is at least partially formed from a material selected from the group consisting of bentonite, hematite, apatite, and crystalline inorganic material.

36. The apparatus as defined in claim 34, wherein the chemical means comprises an additive to said at least one of the layers, and wherein said additive comprises a material selected from the group consisting of zeolites, bentonite, hematite and apatite.

37. The apparatus as defined in claim 36, wherein said at least one of the layers comprises a substantially impermeable layer.

38. The apparatus as defined in claim 1, wherein each layer of the multi-layer barrier contains therein chemical means for (i) chemically immobilizing contaminants disposed in the in-situ portion of earth and (ii) inhibiting movement of said contaminants through said at least one of the layers.

39. The apparatus as defined in claim 38, wherein the chemical means of the first layer is capable of immobilizing a first contaminant, and wherein the chemical means of the second layer is capable of immobilizing a second contaminant.

40. The apparatus as defined in claim 38, wherein the chemical means of the first layer is capable of immobilizing a first contaminant but not a second contaminant, and wherein the chemical means of the second layer is capable of immobilizing a second contaminant but not a first contaminant.

41. The apparatus as defined in claim 38, wherein the multi-layer barrier has at least first, second, third and fourth layers, and wherein the chemical means of the first layer is capable of immobilizing a first contaminant but not a second, third or fourth contaminant, and wherein the chemical means of the second layer is capable of immobilizing a second contaminant but not the first, third or fourth contaminant, and wherein the chemical means of the third layer is capable of immobilizing a third contaminant but not the first, second or fourth contaminant, and wherein the chemical means of the fourth layer is capable of immobilizing a fourth contaminant but not the first, second or third contaminant.

42. The apparatus as defined in claim 1, wherein at least one of the layers of the multi-layer barrier contains therein degrading means for chemically degrading contaminants disposed in the in-situ portion of earth.

43. The apparatus as defined in claim 42, wherein the degrading means comprises an iron-based media capable of chemically reducing the contaminants to non-toxic components.

44. The apparatus as defined in claim 1, wherein at least one of the layers of the multi-layer barrier comprises a self-healing layer having sufficient flexibility and softness to reform and reseal fractured portions of itself back together.

45. An underground containment barrier for containing an in-situ portion of earth having contaminants disposed therein, said barrier comprising:

earthen sidewalls defining an excavated, generally horizontal underground trench beneath the in-situ portion of earth; and a generally horizontal, multi-layer barrier within the generally horizontal trench.

46. The apparatus as defined in claim 45, wherein at least one of the layers of the horizontal barrier is substantially impermeable.

47. The apparatus as defined in claim 45, wherein at least one of the layers of the horizontal barrier is permeable.

48. The apparatus as defined in claim 45, wherein at least one of the layers of the multi-layer barrier contains therein chemical means for (i) chemically immobilizing contaminants disposed in the in-situ portion of earth and (ii) inhibiting movement of said contaminants through said at least one of the layers.

49. The apparatus as defined in claim 48, wherein the chemical means comprises a property of said at least one of the layers, and wherein said layer is at least partially formed from a material selected from the group consisting of bentonite, hematite, apatite, and crystalline inorganic material.

50. The apparatus as defined in claim 48, wherein the chemical means comprises an additive to said at least one of the layers, and wherein said additive comprises a material selected from the group consisting of zeolites and bentonite.

51. The apparatus as defined in claim 50, wherein said at least one of the layers comprises a substantially impermeable layer.

52. The apparatus as defined in claim 45, wherein each layer of the multi-layer barrier contains therein chemical means for (i) chemically immobilizing contaminants disposed in the in-situ portion of earth and (ii) inhibiting movement of said contaminants through said at least one of the layers.

53. The apparatus as defined in claim 52, wherein the multi-layer barrier has at least first and second layers, and wherein the chemical means of the first layer is capable of immobilizing a first contaminant, and wherein the chemical means of the second layer is capable of immobilizing a second contaminant.

54. The apparatus as defined in claim 52, wherein the multi-layer barrier has at least first and second layers, and wherein the chemical means of the first layer is capable of immobilizing a first contaminant but not a second contaminant, and wherein the chemical means of the second layer is capable of immobilizing a second contaminant but not a first contaminant.

55. The apparatus as defined in claim 52, wherein the multi-layer barrier has at least first, second, third and fourth layers, and wherein the chemical means of the first layer is capable of immobilizing a first contaminant but not a second, third or fourth contaminant, and wherein the chemical means of the second layer is capable of immobilizing a second contaminant but not the first, third or fourth contaminant, and wherein the chemical means of the third layer is capable of immobilizing a third contaminant but not the first, second or fourth contaminant, and wherein the chemical means of the fourth layer is capable of immobilizing a fourth contaminant but not the first, second or third contaminant.

56. The apparatus as defined in claim 45, wherein at least one of the layers of the multi-layer barrier contains therein degrading means for chemically degrading contaminants disposed in the in-situ portion of earth.

57. The apparatus as defined in claim 56, wherein the degrading means comprises an iron-based media capable of chemically reducing the contaminants to non-toxic components.

58. The apparatus as defined in claim 45, wherein at least one of the layers of the multi-layer barrier comprises a self-healing layer having sufficient flexibility and softness to reform and reseal fractured portions of itself back together.

59. A method for constructing an underground containment barrier for containing an in-situ portion of earth, said method comprising the steps of:

(a) excavating a generally horizontal trench beneath the in-situ portion of earth substantially without disturbing said in-situ portion and thereby forming a generally horizontal underground trench beneath said in-situ portion defined by opposing earthen sidewalls; and (b) forming a generally horizontal, multi-layer barrier within the horizontal trench comprising a first layer and a second layer disposed above said first layer.

60. The method of claim 59, wherein step (b) further comprises forming the generally horizontal, multi-layer barrier such that at least one of said first and second layers at least partially comprises synthetic material.

61. The method of claim 59, further comprising the steps of:

(c) excavating side trenches adjacent the in-situ portion of earth such that said side trenches are disposed in communication with the horizontal trench;

(d) forming side barriers within the side trenches; and (e) interconnecting the side barriers with the horizontal, multi-layer barrier such that said horizontal and side barriers cooperatively form a one-piece unitary barrier enclosure.

62. The method of claim 61 wherein:

step (c) further comprises excavating interconnected side trenches that continuously surround the in-situ portion of earth;

step (d) further comprises forming interconnected side barriers within the interconnected side trenches such that said side barriers continuously surround the in-situ portion of earth and form an upper perimeter.

63. The method of claim 59, wherein step (b) further comprises forming at least a portion of the second layer simultaneously with forming at least a portion of the first layer.

64. The method of claim 63, wherein step (b) further comprises the steps of:

(f) injecting first material for forming the first layer into the horizontal trench;

(g) placing an intermediate shield over the material for the first layer;

(h) injecting second material for forming the second layer onto the intermediate shield; and (i) removing the intermediate shield from between the first and second material.

65. An apparatus for constructing an underground containment barrier for containing an in-situ portion of earth, said apparatus comprising:

cutting means for cutting earthen material from beneath the in-situ portion of earth without removing said in-situ portion and thereby forming a loosened section of soil beneath the in-situ portion; and barrier-forming means attached to the cutting means for forming a generally horizontal, multi-layer barrier within the generally horizontal trench, said multi-layer barrier having at least a first and a second layer, wherein at least one of said layers is formed in part by the loosened soil cut by the cutting means; and wherein the barrier-forming means comprises means for injecting uncured slurry into the loosened soil to thereby cause the slurry and loosened soil to intermix and cure to form at least one of the layers of the multi-layer barrier.

* * * * *